United States Patent [19]

Heppekausen et al.

[11] Patent Number: 4,974,318

[45] Date of Patent: Dec. 4, 1990

[54] METHOD OF MAKING A DUAL-SHAFT MACHINE

[75] Inventors: Josef Heppekausen, Wesseling; Hans-Peter Kabelitz, Cologne; Karl-Heinz Ronthaler, Zülpich; Ralf Steffens, Cologne, all of Fed. Rep. of Germany

[73] Assignee: Leybold Aktiengesellschaft, Cologne, Fed. Rep. of Germany

[21] Appl. No.: 458,384

[22] Filed: Dec. 28, 1989

Related U.S. Application Data

[63] Continuation of Ser. No. 167,158, Mar. 11, 1988, abandoned.

[30] Foreign Application Priority Data

Mar. 11, 1987 [EP] European Pat. Off. ..... 87103508.5

[51] Int. Cl.[5] ..... B23P 15/00

[52] U.S. Cl. ..... 29/888.023; 29/888.02; 29/434; 418/178

[58] Field of Search ..... 29/888.023, 888.02, 29/888.025, 434, 527.2, 527.4; 418/178, 206; 427/304, 305, 328, 329, 405, 438

[56] References Cited

U.S. PATENT DOCUMENTS

| | | | |
|---|---|---|---|
| 2,754,050 | 7/1956 | Wellington | 418/178 |
| 2,944,732 | 7/1960 | Lorenz . | |
| 3,680,990 | 8/1972 | Pettibone et al. | 418/178 |
| 4,490,102 | 12/1984 | Carré et al. | 418/178 |
| 4,695,233 | 9/1987 | Miyoshi et al. | 418/178 |

FOREIGN PATENT DOCUMENTS

| | | | |
|---|---|---|---|
| 924229 | 2/1955 | Fed. Rep. of Germany . | |
| 3142896 | 8/1982 | Fed. Rep. of Germany . | |
| 0075992 | 6/1981 | Japan | 418/178 |
| 0148292 | 9/1983 | Japan | 418/178 |
| 0196989 | 11/1984 | Japan | 418/178 |
| 0056190 | 4/1985 | Japan | 418/178 |
| 0056191 | 4/1985 | Japan | 418/178 |
| 0230587 | 11/1985 | Japan | 418/178 |
| 0197788 | 9/1986 | Japan | 418/178 |
| 772350 | 4/1957 | United Kingdom . | |
| 1269205 | 4/1972 | United Kingdom . | |

*Primary Examiner*—Howard N. Goldberg
*Assistant Examiner*—I. Cuda
*Attorney, Agent, or Firm*—Spencer & Frank

[57] ABSTRACT

A dual-shaft machine comprising a housing, two pistons rotatably mounted in the housing leaving a cold play spacing between one another and said housing, and a coating provided on either the housing or the pistons, or both, to reduce the cold play spacing to that required by the intended field of use of the machine.

18 Claims, 2 Drawing Sheets

METHOD OF MAKING A DUAL-SHAFT MACHINE

This application is a continuation of application Ser. No. 07/167,158, filed Mar. 11, 1988, abandoned.

BACKGROUND OF THE INVENTION

The present invention relates to a dual-shaft machine including a housing having two pistons rotating within the housing without contacting the housing, and a method of producing the dual-shaft machine.

A dual-shaft machine of this type may be, for example, a Roots pump in which two symmetrically configured pistons rotate within a housing without contacting each other or the housing. The two pistons have essentially a figure-eight-shaped cross section and are synchronized by means of a gear drive. Roots pumps of this type are used as delivery pumps in a vacuum or above the atmospheric pressure range. Other dual-shaft machines are Northey pumps, screw compressors, etc.

Due to the contact-free arrangement of the pistons in the housing, return flow of the displaced medium cannot be avoided. The volumetric efficiency of dual-shaft machines of this type is therefore defined by the ratio of the effectively displaced quantity of gas to the quantity of gas that is theoretically possible to displace. The less play there is between the pistons themselves and between the pistons and the housing wall, the less return flow occurs, and consequently the higher the volumetric efficiency of the dual-shaft machine. However, because of the thermal expansion and contraction of the pistons and housing, it is not possible to select the play as low as desired. The dual-shaft machine heats up during operation and expands, thereby reducing the existing play to a point where the danger exists that the pistons will contact each other or the housing.

With respect to the housing, the heat may be dissipated by way of water or air cooling of the outside of the housing. However, the removal of heat from the rotating pistons is effected essentially by the pumped medium itself which either transfers the heat of the piston to the housing or carries it away. Since, during operation of the dual-shaft machine in a vacuum, only a small amount of medium is available to remove the heat, the thermal problems incurred during this use are particularly critical. Since the degree of heating is directly proportionate to the pressure difference between the outlet and the intake of the machine, and a predetermined temperature difference between the pistons and the housing must not be exceeded, a certain pressure difference must be maintained in the operation of the dual-shaft machine in order to avoid contact between the pistons and the housing. Therefore, if rotary pistons are used in a vacuum, the difference between outlet pressure and intake pressure must not exceed a given permissible value, unless special piston cooling measures have been taken.

To permit the highest possible pressure differences for use in a vacuum, it is known to select the play of the machine in the cold state to be particularly large. As the temperature increases, the pistons expand and the play between them, and between the pistons and the inner wall of the pump chamber decreases so that the machine attains its highest volumetric efficiency only when it reaches the preselected operating temperature.

The only difference between dual-shaft machines for use above atmospheric pressure and machines for use in a vacuum is in the cold play between the rotors themselves and between the rotors and the housing. The piston profile for each is essentially the same. For example, in a Roots blower having a pumping capacity of 1000 $m^3/h$ and intended to be used above atmospheric pressure, the play between the piston and the inner wall of the pump chamber is about 50$\mu$. A Roots pump having the same pumping capacity, and intended for use in a vacuum, has a cold play which is greater by about a factor of four. Therefore, dual-shaft machines of the same type and the same order of magnitude require different pistons, depending on their intended use, resulting in high overall manufacturing costs of the machines.

Dual-shaft machines, particularly Roots pumps, have found wide acceptance in many applications since they can be manufactured and operated relatively economically with respect to their pumping capacity. These applications also include the pumping of gases charged with moisture or other, often corrosive additives. Due to these additives, reactions may occur in the region of the piston surfaces or the inner walls of the pump chamber. The products of these reactions, such as rust or the like, become loose and lead not only to impurities in the pumped gases but also to premature wear of the pump.

SUMMARY OF THE INVENTION

It is an object of the present invention to provide a dual-shaft machine of the above-mentioned type and a method of producing it in which the manufacturing costs connected with adaptation of the machine to the respective field of use are reduced considerably.

This is accomplished according to the present invention by providing a dual-shaft machine of the above-mentioned type in which the pistons and possibly also the inner walls of the pump chamber are coated to adapt the machine to its intended use. In a method of producing the pistons and the housing of this dual-shaft machine, it is proposed to initially machine the pistons and the inner walls of the pump chamber in such a manner that the cold play between the components is greater than would be required for any use and to then adapt the machine to the desired application by coating the pistons and possibly also the housing.

If the proposed coating is intended to set the cold play to a defined value, it is sufficient to coat only the pistons with a predetermined thickness to achieve the desired cold play. If the pistons and the interior of the pump chamber are to be protected against corrosion from the pumped medium or additives contained therein, then it is necessary to coat both the pistons and the inner walls of the pump chamber and to select the appropriate layer thicknesses in such a manner that the desired cold play is realized. The coating material must also be selected to protect against the particular medium or additive being pumped.

It is an advantage of the invention that a plurality of pistons and housings can be manufactured with uniform dimensions for a variety of uses of a dual-shaft machine of a certain type. By applying layers either galvanically or chemically in a relatively simple manner and true to the contours, individual machines can be adapted to their respective field of use. A particular advantage results when the dual-shaft machine according to the invention is used in a vacuum. In the past, the selected cold play was a compromise which permitted use of the machine in the various pressure ranges of a vacuum. The present invention now makes it possible to select the cold play of dual-shaft machines, particularly Roots pumps, in such a manner that it is adapted to the specific application and therefore, its volumetric efficiency is optimized for the particular pressure range.

Another advantage is the possibility of influencing the pumped medium by way of the selected coating material. For example, Roots vacuum pumps are particularly suitable for use in the pump systems of $CO_2$ lasers. The generation of laser light involves the dissociation of the $CO_2$ into CO and $O_2$. If copper is employed as the coating of the active pump surfaces, a catalyst effect occurs which reverses the above-mentioned dissociation. Therefore, the $CO_2$ gas mixture circulating in the gas laser will experience a longer service life. Therefore, due to the longer service life, the gas is required to be exchanged less frequently, and the operating costs for the gas laser are reduced considerably.

DESCRIPTION OF THE PREFERRED EMBODIMENT

Figure 1:
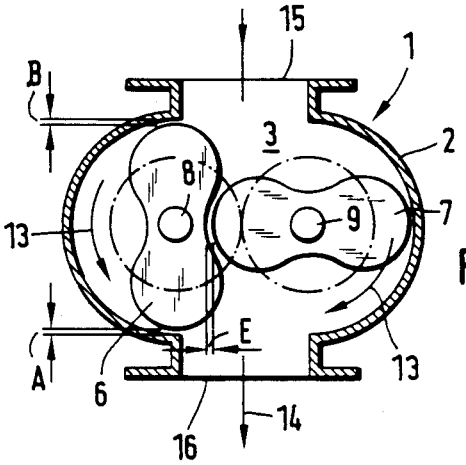
FIGS. 1 and 2 are sectional end elevational views of a conventional dual-shaft machine showing two different piston positions.
Figure 2:
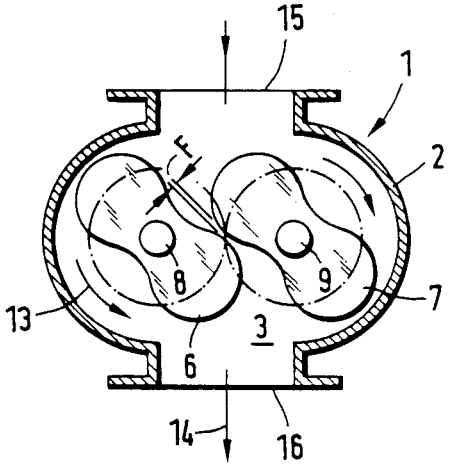
Figure 3:
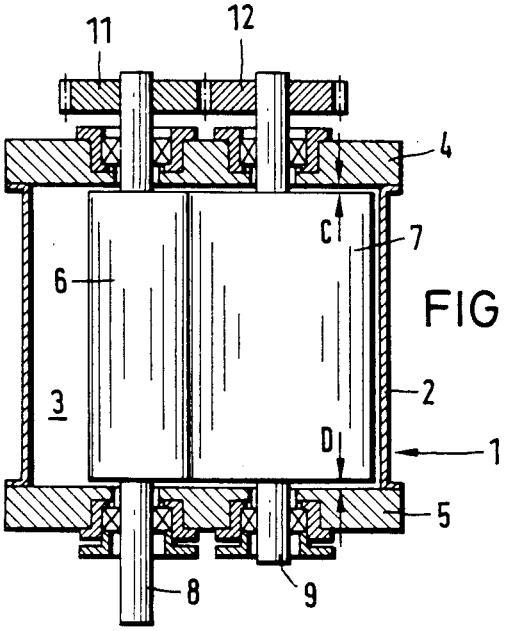
FIG. 3 is a sectional top plan view of the conventional dual-shaft machine shown in FIGS. 1 and 2.

The housing of the Roots pump 1 shown in FIGS. 1 to 3 is designated at 2. The pump chamber 3 is formed by the inner walls of the housing 2 and the side plates 4 and 5 as shown in FIG. 3. Figure-eight shaped pistons 6 and 7 are arranged within the pump chamber such that they rotate without contacting each other or the housing 2. Shafts 8 and 9 carrying the respective pistons 6 and 7 are mounted in side plates 4 and 5. The rotation of pistons 6 and 7 is synchronized by means of meshing gears 11 and 12 which are fastened to ends of the shafts 8 and 9 extending outwardly from the end plate 4. The end of one of the shafts extending from the other end plate 5 is coupled to a drive motor (not shown). Pistons 6 and 7 rotate in the direction of arrows 13 and pump in a direction from the intake 15 to the outlet 16 of the pump as shown by arrow 14.

In FIGS. 1 to 3, the different amounts of play, which are critical for contact-free running of the pistons, are identified by upper case letters. As shown in FIG. 1, A and B identify the play between the peripheries of pistons 6 and 7 and housing 2 on the pressure side and on the suction side of the pump, respectively. As shown in FIG. 3, C identifies the axial play between the frontal faces of pistons 6 and 7 and end plate 4 and D identifies the axial play between the frontal faces of pistons 6 and 7 and end plate 5. The play between pistons 6 and 7 in various positions relative to one another is identified by the letters E and F.

To produce a dual-shaft machine according to FIGS. 1 to 3, pistons 6 and 7, the interior faces of end plates 4 and 5 and the inner walls of housing 2 are initially machined in such a manner that cold plays A to F are greater than that required for any field of use for which this machine is applicable. Then, with coatings positively applied true to the contours of the pump, the cold plays, which were originally too large, are reduced by the desired amount so that dual-shaft machines for different uses can be manufactured simply by providing different coatings in this manner. Additionally, if the machine is susceptible to damage by corrosion due to the pumped media, all of the active surfaces of the pump can be coated. In case only the cold play is to be brought to a predetermined clearance, it is sufficient to coat only the pistons 6 and 7 with the required thicknesses.

Usually, the components of the pump to be coated are made of steel. A preferred coating material is nickel. Nickel coatings can be applied with reproducible thicknesses and true to the contours of the components by a currentless nickel coating process. If the components are to be coated with copper, it is advisable to initially apply a nickel layer as the base layer and then apply the copper layer. The thickness of the two layers should be selected so as to result in the cold play corresponding to that of the intended use. It has been found to be advantageous for the thickness of the copper layer to be 25 $\mu$ and the thickness of the nickel layer to be selected according to the desired cold play to provide a complete layer. Aluminum, chromium and other similar metals may alternatively be used as coating materials.

Figure 4:
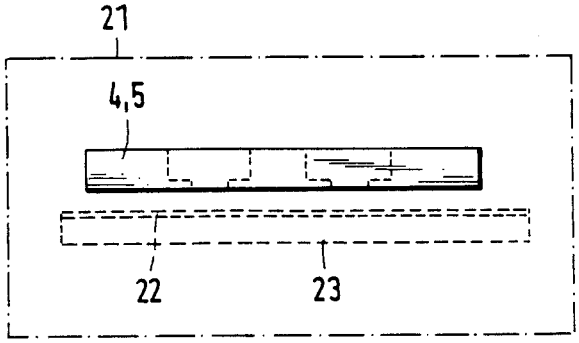
FIGS. 4, 5 and 6 are schematic views of electrode arrangements for a galvanizing process according to the invention.
Figure 5:
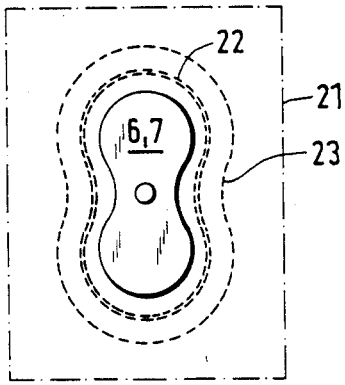
Figure 6:
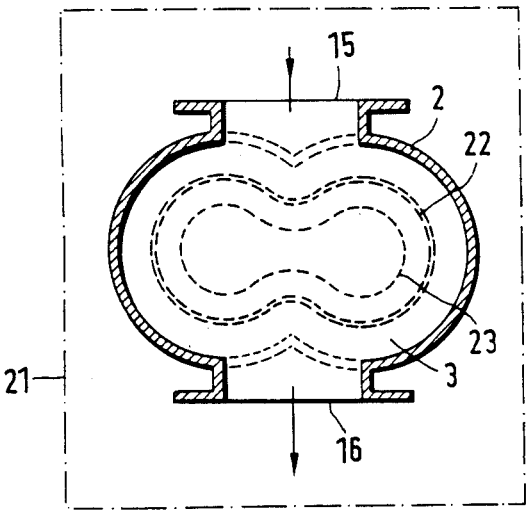

FIGS. 4 to 6 are schematic illustrations of the application of the layers. The numeral 21 in each case identifies the tub of a galvanizing bath into which the components to be coated are immersed. The tub also serves as the cathode for the galvanizing process. The side to be coated is associated with an anode 22 whose shape is adapted to the contour of the surface to be coated. The side plate shown in FIG. 4 thus has an associated planar anode 22. In FIGS. 5 and 6, the exemplary anodes essentially have a figure-eight shape.

The anode 22 of FIG. 5 serving to coat piston 6 or 7 has the shape of a basket and surrounds the piston equidistantly if a uniform layer is to be applied. Planar anode sections (not shown) are associated with the frontal faces of the piston if the frontal faces are also to be coated. By locally changing the distance between the piston and the anode, it is possible to influence the thickness of the applied layer.

In order to coat the inner walls of housing 2, a similar figure-eight shaped basket anode 22 is provided which is disposed essentially equidistantly within pump chamber 3. Also with additional anodes (not shown) the interiors of the pipe stubs (nipples) of intake 15 and outlet 16 may also be coated.

Anodes 22 may be consumable anodes. However, anodes composed of a titanium-expanded metal having a basket shape have been found to be particularly advantageous since they permit a true adaptation to the pump and piston contours. The desired coating material is disposed in the anode basket, preferably in the form of clippings.

It will be understood that the above description of the present invention is susceptible to various modifications, changes and adaptations, and the same are intended to be comprehended within the meaning and range of equivalents of the appended claims.

What is claimed is:

1. A method of producing a dual-shaft vacuum pump for use with a $CO_2$ laser, comprising the following steps:

(a) providing two pistons and a housing defining a pump chamber, (b) machining the pistons and an inner wall of the pump chamber to achieve a cold play spacing between said pistons and said pump chamber essentially equal to the largest cold spacing necessary for all intended uses of the pump, (c) coating at least one of said pump chamber and said pistons with a layer of copper to reduce said cold spacing to that required for the intended field of use of the pump, and (d) rotatably mounting the pistons in the pump chamber so that the pistons do not touch each other and do not touch the inner wall of the pump chamber when the pistons are rotated.

2. A method as defined in claim 1, wherein the step of coating includes coating both the pistons and the inner walls of the pump chamber.

3. A method as defined in claim 1 wherein at least one of the pistons and the inner wall of the pump chamber is galvanically coated with the layer of copper.

4. A method as defined in claim 1 wherein at least one of the pistons and the inner wall of the pump chamber is chemically coated with the layer of copper.

5. A method as defined in claim 1, wherein step (d) is conducted after step (c).

6. A method of producing a dual-shaft machine comprising the following steps:

(a) providing two pistons and a housing defining a pump chamber, (b) machining the pistons and an inner wall of the pump chamber to achieve a cold play spacing between said pistons and said pump chamber essentially equal to the largest cold spacing necessary for all intended uses of the machine, and (c) galvanically coating at least one of said pump chamber and said pistons with a metal to reduce said cold spacing to that required for the intended field of use of the machine, the metal being selected from the group consisting of aluminum, chromium, nickel, and copper, wherein said step of coating includes providing an anode corresponding in shape to the surface to be coated and associating said anode with the surface to be coated.

7. A method as defined in claim 6, including the step of setting the anode at locally different distances from the surfaces to be coated for obtaining coatings of locally varying thicknesses.

8. A method as defined in claim 6, wherein the dual-shaft machine is a vacuum pump for use with a $CO_2$ laser, and wherein the metal employed in step (c) is copper.

9. A method of producing a dual-shaft machine comprising the following steps:

(a) providing two pistons and a housing defining a pump chamber, (b) machining the pistons and an inner wall of the pump chamber to achieve a cold play spacing between said pistons and said pump chamber essentially equal to the largest cold spacing necessary for all intended uses of the machine, and (c) galvanically coating at least one of said pump chamber and said pistons with a metal to reduce said cold spacing to that required for the intended field of use of the machine, the metal being selected from the group consisting of aluminum, chromium, nickel and copper, wherein said step of coating includes providing an anode in the shape of a basket and corresponding in shape to the surface to be coated and associating said anode with the surface to be coated.

10. A method as defined in claim 9, including the step of setting the anode at locally different distances from surfaces to be coated for obtaining coating of locally varying thicknesses.

11. A method as defined in claim 9, wherein the dual-shaft machine is a vacuum pump for use with a $CO_2$ laser, and wherein the metal employed in step (c) is copper.

12. A method of making pumps for use in different applications, comprising the steps of:

(a) making a first pump for use in a first application by (a-1) applying coatings to a first pair of piston elements, the coating applied to the first pair of piston elements having a predetermined first thickness, and (a-2) rotatably mounting the first pair of coated piston elements inside a first pump housing so that the first pair of coated piston elements cooperate with one another; and (b) making a second pump for use in a second application by (b-1) applying coatings to a second pair of piston elements which have the same size and shape as the first pair of piston elements, the coatings applied to the second pair of piston elements having a predetermined second thickness that is greater than the first thickness by a predetermined amount, and (b-2) rotatably mounting the second pair of coated piston elements inside a second pump housing so that the second pair of coated piston elements cooperate with one another, the second pump housing having the same size and shape as the first pump housing.

13. A method as defined in claim 12, wherein the first pump is a vacuum pump and wherein sub-step (a-2) is conducted by rotatably mounting the first pair of coated piston elements inside the first pump housing so that the first pair of coated piston elements do not touch one another during operation of the first pump.

14. A method as defined in claim 12, further comprising applying a coating inside the first pump housing and applying a coating inside the second pump housing, the coatings applied inside the first and second pump housings differing in thickness by a predetermined amount.

15. A method as defined in claim 12, wherein sub-step (a-1) comprises electroplating metal coatings onto the first pair of piston elements.

16. A method as defined in claim 15, wherein the electroplating is conducted using an anode which corresponds in shape to a surface to be electroplated.

17. A method as defined in claim 12, wherein the first pump is a vacuum pump for use with a $CO_2$ laser, and wherein sub-step (a-1) comprises electroplating copper coatings onto the first pair of piston elements.

18. A method of producing a dual-shaft vacuum pump for pumping a $CO_2$ laser, the $CO_2$ laser having a tendency to dissociate $CO_2$ into CO and $O_2$ during use, said method comprising the following steps:

(a) providing two pistons and a housing defining a pump chamber, (b) machining the pistons and an inner wall of the pump chamber to achieve a cold play spacing between said pistons and said pump chamber essentially equal to the largest cold spacing necessary for all intended uses of the pump, (c) coating at least one of said pump chamber and said pistons with a layer of copper to reduce said cold spacing to that required for the intended field of use of the pump, the layer of copper additionally providing a catalytic effect to reverse the dissociation of $CO_2$, and (d) rotatably mounting the pistons in the pump chamber so that the pistons do not touch each other and do not touch the inner wall of the pump chamber when the pistons are rotated.

* * * * *